US010371365B2

(12) United States Patent
Moore

(10) Patent No.: US 10,371,365 B2
(45) **Date of Patent: *Aug. 6, 2019**

(54) REDIRECTED LIGHT BEAM FOR WEAPONS

(71) Applicant: CRIMSON TRACE CORPORATION, Wilsonville, OR (US)

(72) Inventor: Larry E. Moore, Cottonwood, AZ (US)

(73) Assignee: Crimson Trace Corporation, Wilsonville, OR (US)

( * ) Notice: Subject to any disclaimer, the term of this patent is extended or adjusted under 35 U.S.C. 154(b) by 209 days.

This patent is subject to a terminal disclaimer.

(21) Appl. No.: 15/439,608

(22) Filed: Feb. 22, 2017

(65) Prior Publication Data

US 2017/0160054 A1 Jun. 8, 2017

Related U.S. Application Data

(63) Continuation of application No. 14/630,467, filed on Feb. 24, 2015, now Pat. No. 9,644,826.

(60) Provisional application No. 61/984,655, filed on Apr. 25, 2014.

(51) Int. Cl.

| | |
|---|---|
| ***F21V 7/00*** | (2006.01) |
| ***F21V 23/04*** | (2006.01) |
| ***F21V 21/40*** | (2006.01) |
| ***F21V 23/02*** | (2006.01) |
| ***F41G 1/36*** | (2006.01) |
| ***F41G 1/35*** | (2006.01) |
| ***F21V 14/02*** | (2006.01) |

(52) U.S. Cl.

CPC ..... *F21V 23/04* (2013.01); *F21V 7/00* (2013.01); *F21V 14/02* (2013.01); *F21V 21/40* (2013.01); *F21V 23/02* (2013.01); *F21V 23/023* (2013.01); *F41G 1/35* (2013.01); *F41G 1/36* (2013.01)

(58) Field of Classification Search

CPC ..... F21V 23/04; F21V 23/023; F21V 21/40; F21V 7/00; F41G 1/35; F41G 1/36

See application file for complete search history.

(56) References Cited

U.S. PATENT DOCUMENTS

| | | | |
|---|---|---|---|
| 1,490,272 | A | 4/1924 | Hickam |
| 1,898,566 | A | 2/1933 | Noel |
| 2,268,056 | A | 12/1941 | Nelson et al. |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

UPSTO; Notice of Allowance and Fees Due dated Jul. 11, 2017 in U.S. Appl. No. 15/130,744.

(Continued)

*Primary Examiner* — David V Bruce

(74) *Attorney, Agent, or Firm* — Schwabe, Williamson & Wyatt, P.C.

(57) ABSTRACT

A lighting device for a gun includes a mirror to redirect a light beam emanating from the lighting device. The light beam can be redirected along the side or top of the gun and preferably parallel to the axis of the gun barrel. The lighting device preferably is or includes a laser module.

26 Claims, 9 Drawing Sheets

(56) References Cited

U.S. PATENT DOCUMENTS

| | | | |
|---|---|---|---|
| 2,308,627 | A | 1/1943 | Rickenbacher |
| 2,357,951 | A | 9/1944 | Hale |
| 2,430,469 | A | 11/1947 | Karnes |
| 2,597,565 | A | 5/1952 | Chandler et al. |
| 2,701,930 | A | 2/1955 | Dolan |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Zinsser |
| 2,894,117 | A | 7/1959 | Koskey |
| 2,904,888 | A | 9/1959 | Niesp |
| 2,926,916 | A | 3/1960 | Pearson |
| 3,104,478 | A | 9/1963 | Strauss |
| 3,112,567 | A | 12/1963 | Flanagan |
| 3,284,905 | A | 3/1964 | Simmons |
| 3,192,915 | A | 7/1965 | Norris et al. |
| 3,510,965 | A | 5/1970 | Rhea |
| 3,526,972 | A | 9/1970 | Sumpf |
| 3,573,868 | A | 4/1971 | Giannetti |
| 3,618,673 | A | 11/1971 | Gossett |
| 3,633,285 | A | 1/1972 | Sensney |
| 3,641,676 | A | 2/1972 | Knutsen et al. |
| 3,645,635 | A | 2/1972 | Steck |
| 3,748,751 | A | 7/1973 | Breglia |
| 3,801,205 | A | 4/1974 | Eggenschwyler |
| 3,813,795 | A | 6/1974 | Marshall |
| 3,914,873 | A | 10/1975 | Elliot, Jr. et al. |
| 3,948,522 | A | 4/1976 | Fixler |
| 3,992,783 | A | 11/1976 | Dunlap et al. |
| 3,995,376 | A | 12/1976 | Kimble et al. |
| 4,026,054 | A | 5/1977 | Snyder |
| 4,048,489 | A | 9/1977 | Giannetti |
| 4,063,368 | A | 12/1977 | McFarland |
| 4,079,534 | A | 3/1978 | Snyder |
| 4,102,059 | A | 7/1978 | Kimble et al. |
| 4,144,505 | A | 3/1979 | Angelbeck et al. |
| 4,146,329 | A | 3/1979 | King et al. |
| 4,148,245 | A | 4/1979 | Steffanus et al. |
| 4,156,981 | A | 6/1979 | Lusk |
| 4,168,588 | A | 9/1979 | Snyder |
| 4,220,983 | A | 9/1980 | Schroeder |
| 4,222,564 | A | 9/1980 | Allen |
| 4,229,103 | A | 10/1980 | Hipp |
| 4,232,867 | A | 11/1980 | Tate |
| 4,233,770 | A | 11/1980 | de Filippis et al. |
| 4,234,911 | A | 11/1980 | Faith |
| 4,295,289 | A | 10/1981 | Snyder |
| 4,305,091 | A | 12/1981 | Cooper |
| 4,346,530 | A | 8/1982 | Stewart |
| 4,348,828 | A | 9/1982 | Snyder |
| 4,352,665 | A | 10/1982 | Kimble et al. |
| 4,452,458 | A | 6/1984 | Timander |
| 4,481,561 | A | 11/1984 | Lanning |
| 4,487,583 | A | 12/1984 | Brucker |
| 4,488,369 | A | 12/1984 | Van Note |
| 4,541,191 | A | 9/1985 | Morris et al. |
| 4,567,810 | A | 2/1986 | Preston |
| 4,662,845 | A | 5/1987 | Gallaher |
| 4,713,889 | A | 12/1987 | Santiago |
| 4,763,431 | A | 8/1988 | Allan et al. |
| 4,825,258 | A | 4/1989 | Whitson |
| 4,830,617 | A | 5/1989 | Hancox et al. |
| 4,860,775 | A | 8/1989 | Reeves |
| 4,876,816 | A | 10/1989 | Triplett |
| 4,878,307 | A | 11/1989 | Singletary |
| 4,891,476 | A | 1/1990 | Nation et al. |
| 4,934,086 | A | 6/1990 | Houde-Walter |
| 4,939,320 | A | 7/1990 | Graulty |
| 4,939,863 | A | 7/1990 | Alexander et al. |
| 4,945,667 | A | 8/1990 | Rogalski et al. |
| 4,953,316 | A | 9/1990 | Litton et al. |
| 4,967,642 | A | 11/1990 | Mihaita |
| 5,001,836 | A | 3/1991 | Cameron et al. |
| 5,004,423 | A | 4/1991 | Bertrams |
| 5,033,219 | A | 7/1991 | Johnson et al. |
| 5,048,211 | A | 9/1991 | Hepp |
| 5,048,215 | A | 9/1991 | Davis |
| 5,052,138 | A | 10/1991 | Crain |
| 5,090,805 | A | 2/1992 | Stawarz |
| 5,092,071 | A | 3/1992 | Moore |
| 5,119,576 | A | 6/1992 | Erning |
| 5,177,309 | A | 1/1993 | Willoughby et al. |
| 5,178,265 | A | 1/1993 | Sepke |
| 5,179,235 | A | 1/1993 | Toole |
| 5,194,007 | A | 3/1993 | Marshall |
| 5,197,796 | A | 3/1993 | Moore |
| 5,208,826 | A | 5/1993 | Kelly |
| 5,179,124 | A | 6/1993 | Schoenwald et al. |
| 5,228,427 | A | 7/1993 | Gardner |
| 5,237,773 | A | 8/1993 | Claridge |
| 5,241,146 | A | 8/1993 | Priesemuth |
| 5,272,514 | A | 12/1993 | Dor |
| 5,299,375 | A | 4/1994 | Thummel et al. |
| 5,343,376 | A | 8/1994 | Huang |
| 5,353,208 | A | 10/1994 | Moore |
| 5,355,608 | A | 10/1994 | Teetzel |
| 5,355,609 | A | 10/1994 | Schenke |
| 5,365,669 | A | 11/1994 | Rustick et al. |
| 5,367,779 | A | 11/1994 | Lee |
| 5,373,644 | A | 12/1994 | De Paoli |
| 5,375,362 | A | 12/1994 | McGarry et al. |
| 5,388,335 | A | 2/1995 | Jung |
| 5,392,550 | A | 2/1995 | Moore et al. |
| 5,400,540 | A | 3/1995 | Solinsky et al. |
| 5,419,072 | A | 5/1995 | Moore et al. |
| 5,432,598 | A | 7/1995 | Szatkowski |
| 5,435,091 | A | 7/1995 | Toole et al. |
| 5,446,535 | A | 8/1995 | Williams |
| 5,448,834 | A | 9/1995 | Huang |
| 5,454,168 | A | 10/1995 | Langner |
| 5,455,397 | A | 10/1995 | Havenhill et al. |
| 5,467,552 | A | 11/1995 | Cupp et al. |
| 5,488,795 | A | 2/1996 | Sweat |
| D368,121 | S | 3/1996 | Lam |
| 5,509,226 | A | 4/1996 | Houde-Walter |
| 5,499,455 | A | 5/1996 | Palmer |
| 5,515,636 | A | 5/1996 | McGarry et al. |
| 5,481,819 | A | 6/1996 | Teetzel |
| 5,531,040 | A | 7/1996 | Moore |
| 5,555,662 | A | 9/1996 | Teetzel |
| 5,557,872 | A | 9/1996 | Langner |
| 5,566,459 | A | 10/1996 | Breda |
| 5,581,898 | A | 12/1996 | Thummel |
| 5,584,137 | A | 12/1996 | Teetzel |
| 5,590,486 | A | 1/1997 | Moore |
| 5,598,958 | A | 2/1997 | Ryan, III et al. |
| 5,605,461 | A | 2/1997 | Seeton |
| 5,618,099 | A | 4/1997 | Brubacher |
| 5,621,999 | A | 4/1997 | Moore |
| 5,622,000 | A | 4/1997 | Marlowe |
| 5,654,594 | A | 8/1997 | Bjornsen, III |
| 5,669,174 | A | 9/1997 | Teetzel |
| 5,671,561 | A | 9/1997 | Johnson et al. |
| 5,685,106 | A | 11/1997 | Shoham |
| 5,685,636 | A | 11/1997 | German |
| 5,694,202 | A | 12/1997 | Mladjan et al. |
| 5,694,713 | A | 12/1997 | Paldino |
| 5,704,153 | A | 1/1998 | Kaminski et al. |
| 5,706,600 | A | 1/1998 | Toole et al. |
| 5,716,216 | A | 2/1998 | O'Loughlin |
| 5,735,070 | A | 4/1998 | Vasquez et al. |
| 5,787,631 | A | 8/1998 | Kendall |
| 5,788,500 | A | 8/1998 | Gerber |
| 5,822,905 | A | 10/1998 | Teetzel |
| 5,842,300 | A | 12/1998 | Cheshelski et al. |
| 5,842,942 | A | 12/1998 | Doht et al. |
| 5,847,345 | A | 12/1998 | Harrison |
| 5,867,930 | A | 2/1999 | Kaminski et al. |
| 5,881,707 | A | 3/1999 | Gardner |
| 5,892,221 | A | 4/1999 | Lev |
| 5,896,691 | A | 4/1999 | Kaminski et al. |
| 5,905,238 | A | 5/1999 | Hung |
| 5,909,951 | A | 6/1999 | Johnsen et al. |
| 5,922,030 | A | 7/1999 | Shank et al. |

(56) References Cited

U.S. PATENT DOCUMENTS 5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,378,237 B1 4/2002 Matthews et al.
6,385,893 B1 5/2002 Cheng
6,389,729 B2 5/2002 Rauch et al.
6,389,730 B1 5/2002 Millard
6,397,509 B1 6/2002 Langner
6,421,947 B1 7/2002 Fuller
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,571,503 B2 6/2003 Thorpe
6,572,375 B2 6/2003 Shechter et al.
6,575,753 B2 6/2003 Rosa et al.
6,578,311 B2 6/2003 Danielson et al.
6,579,098 B2 6/2003 Shechter et al.
6,591,536 B2 7/2003 Houde-Walter et al.
6,606,797 B1 8/2003 Gandy
6,614,510 B1 9/2003 Rogers et al.
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
6,682,350 B2 1/2004 Kehl
D487,791 S 3/2004 Freed
6,742,299 B2 6/2004 Strand
6,749,075 B2 6/2004 Bourque
6,782,789 B2 8/2004 McNulty
6,804,907 B1 10/2004 Slobodkin
6,843,478 B1 1/2005 Hoepelman
6,854,205 B2 2/2005 Wikle et al.
6,860,053 B2 3/2005 Christiansen
6,931,775 B2 8/2005 Burnett
6,935,864 B2 8/2005 Shechter et al.
6,945,782 B2 9/2005 Isoz
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 6/2008 Chang
RE40,429 E 7/2008 Oliver et al.
7,409,770 B2 8/2008 Jones
D578,599 S 10/2008 Cheng
7,438,430 B2 10/2008 Kim
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese
8,104,220 B2 1/2012 Cobb
D653,798 S 2/2012 Janice et al.
8,109,024 B2 2/2012 Abst
8,110,760 B2 2/2012 Sharrah et al.
8,127,485 B2 3/2012 Moore
8,132,352 B2 3/2012 Lippard
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,147,304 B2 4/2012 Yamada

(56) References Cited

U.S. PATENT DOCUMENTS 8,151,504 B1 4/2012 Aiston
8,151,505 B2 4/2012 Thompson
8,166,694 B2 5/2012 Swan
8,172,139 B1 5/2012 McDonald et al.
8,182,109 B2 5/2012 Matthews et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 1/2013 Rosol et al.
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,646,201 B2 2/2014 Hughes
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,915,009 B2 12/2014 Caulk
8,919,023 B2 12/2014 Merritt et al.
8,927,083 B2 1/2015 Pell
8,938,904 B1 1/2015 Sellers et al.
D722,125 S 2/2015 Zayatz
8,944,626 B2 2/2015 Matthews et al.
8,944,838 B2 2/2015 Mulfinger
8,991,093 B1 3/2015 Calvert
9,011,279 B2 4/2015 Johnson et al.
9,023,459 B2 5/2015 Hogue
9,146,077 B2 9/2015 Moore
9,182,194 B2 11/2015 Moore
9,188,407 B2 11/2015 Moore
9,243,865 B1 1/2016 Bruhns
9,272,402 B2 3/2016 Hu
9,297,614 B2 3/2016 Moore
9,453,702 B2 9/2016 Bruhns
9,644,826 B2 * 5/2017 Moore ..... F21V 23/04
9,658,031 B1 5/2017 Hedeen
9,772,163 B2 9/2017 Sharrah et al.
9,777,984 B1 10/2017 Bonine
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore et al.
9,915,508 B2 3/2018 Moore et al.
9,982,963 B2 5/2018 Johnson
10,113,836 B2 10/2018 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 9/2002 Iafrate et al.
2002/0134000 A1 9/2002 Varshneya et al.
2002/0148153 A1 10/2002 Thorpe
2002/0194767 A1 12/2002 Houde Walter et al.
2003/0003424 A1 1/2003 Shechter et al.
2003/0022135 A1 1/2003 Shechter et al.
2003/0029072 A1 3/2003 Danielson
2003/0084601 A1 5/2003 Kunimoto
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 4/2004 Luke
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.

(56) References Cited

U.S. PATENT DOCUMENTS

| | | | |
|---|---|---|---|
| 2010/0175297 | A1 | 7/2010 | Speroni |
| 2010/0227298 | A1 | 9/2010 | Charles |
| 2010/0229448 | A1 | 9/2010 | Houde-Walter |
| 2010/0263254 | A1 | 10/2010 | Glock |
| 2010/0275496 | A1 | 11/2010 | Solinsky et al. |
| 2011/0047850 | A1 | 3/2011 | Rievley et al. |
| 2011/0061283 | A1 | 3/2011 | Cavallo |
| 2011/0074303 | A1 | 3/2011 | Stokes |
| 2011/0119868 | A1 | 5/2011 | LaLonde |
| 2011/0154712 | A1 | 6/2011 | Moore |
| 2011/0162249 | A1 | 7/2011 | Woodmansee et al. |
| 2011/0162251 | A1 | 7/2011 | Houde-Walter |
| 2011/0185619 | A1 | 8/2011 | Finnegan et al. |
| 2011/0225867 | A1 | 9/2011 | Moore |
| 2012/0005938 | A1 | 1/2012 | Sloan |
| 2012/0047787 | A1 | 3/2012 | Curry |
| 2012/0055061 | A1 | 3/2012 | Hartley et al. |
| 2012/0110886 | A1 | 5/2012 | Moore et al. |
| 2012/0124885 | A1 | 5/2012 | Caulk et al. |
| 2012/0129136 | A1 | 5/2012 | Dvorak |
| 2012/0144716 | A1 | 6/2012 | Cabahug et al. |
| 2012/0144718 | A1 | 6/2012 | Danielson |
| 2012/0180366 | A1 | 7/2012 | Jaroh et al. |
| 2012/0180367 | A1 | 7/2012 | Singh |
| 2012/0180370 | A1 | 7/2012 | McKinley |
| 2012/0224357 | A1 | 9/2012 | Moore |
| 2012/0224387 | A1 | 9/2012 | Moore |
| 2012/0268920 | A1 | 10/2012 | Matthews |
| 2013/0185978 | A1 | 7/2013 | Dodd et al. |
| 2013/0185982 | A1 | 7/2013 | Hilbourne et al. |
| 2013/0205635 | A1 | 8/2013 | Hines |
| 2013/0263492 | A1 | 10/2013 | Erdle |
| 2013/0318851 | A1 | 12/2013 | Diamond |
| 2014/0007485 | A1 | 1/2014 | Castejon |
| 2014/0109457 | A1 | 4/2014 | Speroni |
| 2014/0157645 | A1 | 6/2014 | Moore |
| 2014/0176463 | A1 | 6/2014 | Donahoe |
| 2014/0256481 | A1 | 9/2014 | Flint |
| 2014/0355258 | A1 | 12/2014 | Izumi et al. |
| 2015/0192391 | A1 | 7/2015 | Moore |
| 2015/0226508 | A1 | 8/2015 | Hughes |
| 2015/0233668 | A1 | 8/2015 | Moore |
| 2015/0283459 | A1 | 10/2015 | Condon |
| 2015/0308670 | A1 | 10/2015 | Moore |
| 2015/0345905 | A1 | 12/2015 | Hancosky |
| 2015/0348330 | A1 | 12/2015 | Balachandreswaran |
| 2016/0059136 | A1 | 3/2016 | Ferris |
| 2016/0084618 | A1 | 3/2016 | Hong |
| 2016/0091285 | A1 | 3/2016 | Mason |
| 2016/0161220 | A1 | 6/2016 | Moore |
| 2016/0169608 | A1 | 6/2016 | Schulz |
| 2016/0195366 | A1 | 7/2016 | Kowalczyk et al. |
| 2016/0209170 | A1 | 7/2016 | Mock et al. |
| 2016/0209174 | A1 | 7/2016 | Hartley et al. |
| 2016/0245617 | A1 | 8/2016 | Moore |
| 2016/0305748 | A1 | 10/2016 | Moore |
| 2016/0361626 | A1 | 12/2016 | Moore |
| 2017/0003103 | A1 | 1/2017 | Moore |
| 2017/0030677 | A1 | 2/2017 | Faifer |
| 2017/0082399 | A1 | 3/2017 | Moore |
| 2017/0153095 | A1 | 6/2017 | Moore |
| 2017/0205182 | A1 | 7/2017 | Hughes et al. |
| 2018/0023923 | A1 | 1/2018 | Uhr |
| 2018/0058804 | A1 | 3/2018 | Moore |
| 2018/0135944 | A1 | 5/2018 | Moore |
| 2018/0149443 | A1 | 5/2018 | Dottle |

OTHER PUBLICATIONS

USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.
USPTO; Final Office Action dated May 18, 2017 in U.S. Appl. No. 15/243,813.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.
USPTO; Advisory Action dated May 15, 2018 in U.S. Appl. No. 14/963,475.
USPTO; Supplemental Notice of Allowance dated Sep. 13, 2017 in U.S. Appl. No. 15/166,145.
USPTO; Final Office Action dated Sep. 28, 2017 in U.S. Appl. No. 15/243,813.
USPTO; Notice of Allowance dated Oct. 27, 2017 in U.S. Appl. No. 14/955,440.
USPTO; Notice of Allowance dated Nov. 13, 2017 in U.S. Appl. No. 14/955,440.
USPTO; Notice of Allowance dated Apr. 26, 2017 in U.S. Appl. No. 15/130,744.
USPTO; Final Office Action dated Aug. 31, 2018 in U.S. Appl. No. 15/804,229.
USPTO; Notice of Allowance dated Aug. 31, 2018 in U.S. Appl. No. 15/075,769.
USPTO; Non-Final Office Action dated Sep. 19, 2018 in U.S. Appl. No. 15/243,813.
USPTO; Notice of Allowance dated Oct. 3, 2018 in U.S. Appl. No. 15/884,122.
USPTO; Requirement for Restriction dated Jun. 11, 2018 in U.S. Appl. No. 15/181,279.
USPTO; Advisory Action dated Jun. 14, 2018 in U.S. Appl. No. 15/253,543.
USPTO; Notice of Allowance dated Jun. 20, 2018 in U.S. Appl. No. 15/787,134.
USPTO; Non-Final Office Action dated Jun. 29, 2018 in U.S. Appl. No. 15/600,571.
USPTO; Non-Final Office Action dated Jul. 3, 2018 in U.S. Appl. No. 14/963,475.
USPTO; Notice of Allowance dated Jul. 18, 2018 in U.S. Appl. No. 15/075,769.
USPTO; Non-Final Office Action dated Jul. 20, 2018 in U.S. Appl. No. 15/253,543.
Google Search for crossbow laser, image search conducted on Nov. 29, 2017, 14 pages.
Google Search for crossbow laser, image search conducted on Nov. 29, 2017, 2 pages.
CrossbowNation-Community-Gear Review, Crossbow Laser Boresighter Bolt Video Review, 1 page, printed on Nov. 29, 2017, dated Apr. 18, 2010.
CrossbowNation, Gear Review, Crossbow Laser Boresighter Bolt Video Review, 6 images taken therefrom, 6 pages, printed on Nov. 29, 2017, dated Apr. 18, 2010.
Ducet, "Arsenal Strike One Review," http://dennyducet.blogspot.com/2015/06/the-arsenal-strike-one-innovative.html, (Jun. 18, 2015).
USPTO; Non-Final Office Action dated Dec. 7, 2017 in U.S. Appl. No. 15/075,769.
USPTO; Non-Final Office Action dated Dec. 18, 2017 in U.S. Appl. No. 15/787,134.
USPTO; Final Office Action dated Jan. 16, 2018 in U.S. Appl. No. 14/963,475.
USPTO; Final Office Action dated Feb. 7, 2018 in U.S. Appl. No. 15/253,543.
USPTO; Non-Final Office Action dated Feb. 8, 2018 in U.S. Appl. No. 14/863,304.
USPTO; Non-Final Office Action dated Feb. 26, 2018 in U.S. Appl. No. 15/804,229.
EPO; Office Action dated Oct. 5, 2011 in Serial No. 09169459.
EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.

(56) References Cited

OTHER PUBLICATIONS

EPO; Search Opinion and Report dated Aug. 6, 2010 in Serial No. 09169469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
USPTO; Notice of Allowance dated Nov. 15, 2016 in U.S. Appl. No. 14/630,467.
USPTO; Non-Final Office Action dated Aug. 30, 2016 in U.S. Appl. No. 14/955,440.
UPSTO; Non-Final Office Action dated Oct. 6, 2016 in U.S. Appl. No. 15/243,813.

(56) References Cited

OTHER PUBLICATIONS

USPTO; Office Action dated Feb. 24, 2017 in U.S. Appl. No. 15/166,145.
USPTO; Notice of Allowance dated Mar. 7, 2017 in U.S. Appl. No. 14/630,467.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.

* cited by examiner

REDIRECTED LIGHT BEAM FOR WEAPONS

CROSS-REFERENCE TO RELATED APPLICATIONS

This application claims priority to, and is a continuation of U.S. application Ser. No. 14/630,467 entitled "Weapon with Redirected Lighting Beam filed Feb. 24, 2015," which claimed priority to U.S. Provisional Patent Application No. 61/984,655 filed Apr. 25, 2014 and entitled "WEAPON WITH REDIRECTED LIGHTING BEAM," the respective disclosures of which are incorporated herein by reference.

FIELD OF THE INVENTION

The present invention is directed to a lighting device for a firearm that uses a mirror to redirect the light beam along the side or top of the firearm and preferably parallel to the longitudinal axis of the firearm's barrel.

BACKGROUND OF THE INVENTION

As used herein, "light source" means any source of light, such as a laser or flashlight. "Laser" means any form of laser light source that projects a beam of laser light suitable for weapon alignment or sighting purposes.

It is known to utilize a light beam, such as a beam from a laser, as a sighting aid for weapons, particularly guns. A laser beam is preferred because it has comparatively high intensity, can be focused into a narrow beam with a small divergence angle so it produces a small, bright spot on a target. When the light beam and gun bore are properly aligned, the bullet (or other projectile) will hit on or very close to the location of the spot produced by the laser on the target.

It is, however, difficult to mount lasers to small guns, particularly small revolvers, that can be concealed in a pocket or purse. The problem is that the laser and associated mechanisms are too large for the gun. Consequently, they interfere with the operation of the gun and/or make the gun more difficult to conceal.

The disclosures of the following references that are not inconsistent with this disclosure are incorporated herein by reference: U.S. Pat. No. 8,127,485 entitled "GUN WITH MOUNTED SIGHTING DEVICE" to Moore et al., U.S. Pat. No. 8,312,665 entitled "SIDE-MOUNTED LIGHTING DEVICE" to Moore et al. and U.S. patent application Ser. No. 13/707,312 entitled "SIGHTING DEVICE REPLICATING SHOTGUN PATTERN SPREAD" to Moore et al.

SUMMARY OF THE INVENTION

Embodiments of the present invention are mountable on a gun, particularly a small revolver, without interfering with the operation of the gun or affecting the ability to conceal the gun. Disclosed is a laser (or other light source) that is disposed in a grip of the gun. In the embodiments shown, the laser module is mounted at an angle of 0°-45° from the vertical axis and is not positioned so that it is in line with the longitudinal axis of the gun barrel. A mirror is positioned adjacent the end of the laser module that emits light, and the mirror redirects the light, preferably parallel to the longitudinal axis of the gun barrel to enable a user to sight the gun.

DETAILED DESCRIPTION OF PREFERRED EMBODIMENTS

Figure 1:
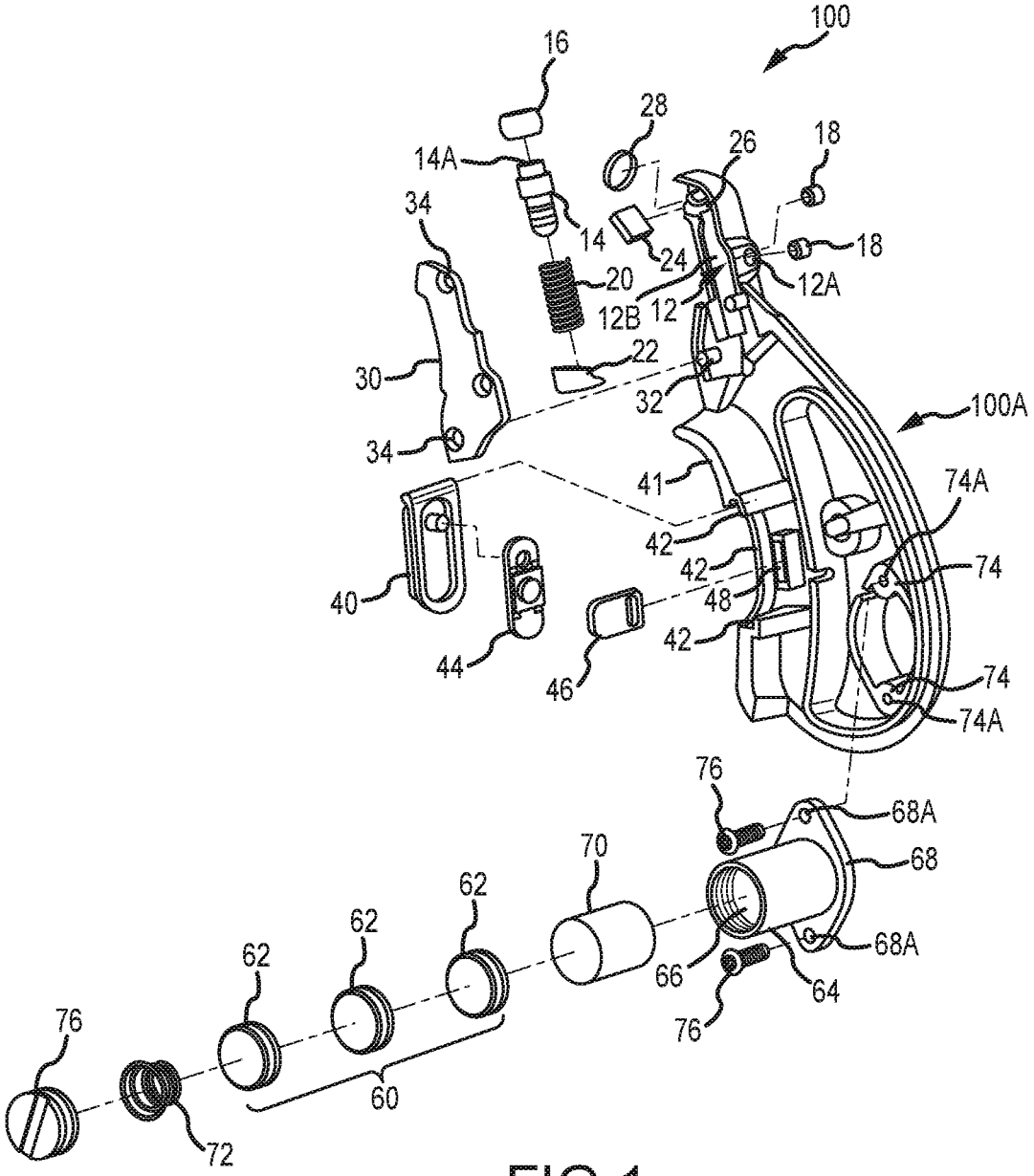
FIG. 1 is an exploded view of a lighting device according to aspects of the invention showing how the device fits onto part of the gun grip.

Turning now to the Figures where the purpose is to describe preferred embodiments of the invention and not limit same, FIG. 1 is an exploded view of a first section 100 of a grip according to aspects of the invention. First section, or grip portion, 100 is preferably made of plastic, metal or a combination thereof and most preferably of injection-molded plastic, and has a main body portion 100A.

In this embodiment, a housing 12 includes a cavity 12B, and is integrally formed as part of first section 100 (although it could be connected to first section 100 in any suitable manner). The cavity 12B of housing 12 is dimensioned to receive laser module 14. In this embodiment module 14 has a first end 14A through which laser light is emitted.

A module nose ball 16 fits over laser module 14 and allows the module 14 to pivot so its position can be adjusted, thereby adjusting the direction of the light beam emitted from end 14A. Housing 12 has an outer wall with two openings 12A, each of which receive a set screw 18 (or other suitable device) that can be tightened or loosened in an opening 12A to alter the position of laser module 14 in housing 12. As shown, the openings 12A and corresponding set screws 18 are positioned 90° apart and are in a axial alignment approximately perpendicular to the longitudinal axis of laser module 14 when module 14 is positioned in cavity 12B of housing 12.

Before laser module 14 is positioned in housing 12, module nose ball 16, a biasing spring 20, and a spring bias insert 22 are positioned on module 14. The combination of spring 20 and spring bias insert 22 bias the laser module 14 towards the two set screws 18. In this manner, as one or more of set screws 18 is loosened the laser module 14 will move in the direction of that set screw(s). Spring 20 may also provide a negative electrical contact for laser module 14.

A mirror 24 fits into a slot 26 integrally formed as part of first section 100. In the embodiment shown, mirror 24 is stationary, but it could be adjustable to adjust, or help adjust, the travel of the light beam emitted from first end 14A. In the embodiment shown, mirror 24 deflects the travel of light emitted from end 14A of laser module 14 so that the light preferably travels along the side or top of a gun, preferably parallel to the axis of the gun barrel, to properly sight a target. Light reflected from the mirror 26 passes through a lens 28. Lens 28 fits onto first section 100 and is transparent, colored, or translucent, and could be a diffraction lens. For example, lens 28 may alter the laser light existing the internal laser module, such as to create a pattern of light, such as a cross hair, vertical beam, horizontal beam, circular pattern of light beams, or circular pattern of light beams with a light beam in the center of the circumference of the circular pattern.

A back cover 30 is positioned onto first section 100 to retain mirror 24, laser module 14, laser module nose ball, spring 20 and spring bias insert 22 in place and protect them. Cover 30 can be attached to first section main body 100A in any suitable fashion but is preferably snap fit into place by projections 32 being received in openings 34. Alternatively, screws could be passed through openings 34 and projections 32 could be threaded or contain screw bosses to retain the screws.

A button, or switch, 40 is preferably a momentary switch that is pressure activated by a user squeezing it. Most preferably a user must apply at least 2, at least 3, or at least 5, pounds of force to activate switch 40 because in that manner a user would not accidentally activate the switch 40 simply by grasping the grip. Alternatively, another type of switch may be used and the switch may be at any suitable location. A PCB 44 is positioned in the back of switch 40. When switch 40 is activated, PCB 44 is moved and it connects the power source 60 to the laser module 14 to emit light from end 14A.

Switch 40 and PCB 44 fit into slot 42 of main body 100A, and there is a corresponding slot (shown in FIG. 2) on second section 200, so that when sections 100 and 200 are connected through the gun handle frame 502, they hold the switch 40 and PCB 44 in place.

A button press tab 46 is retained in slot 48. The power source 60 comprises three 3V photo cell batteries 62, although any suitable power source (preferably a light and portable 3V source) can be used. The power source (batteries 62) in this embodiment are retained in a tube 64 that is preferably cylindrical with a cavity 66 and a mounting board 68 that communicates with PCB 44 when switch 40 is activated.

An insulation sleeve 70 is positioned in cavity 66 and batteries 62 are positioned inside the sleeve 70. Contact board 68 is positioned on frame 74 of main body 100A and is preferably retained in place by screws 76 being positioned through openings 68A and threaded into openings 74A. Insulation sleeve 70 is positioned in cavity 66 and batteries 62 are placed inside sleeve 70. Then spring 72 is placed inside of cavity 66 to bias batteries 62 towards board 68, and a cap 76 is placed on the end of battery tube 64, preferably by threading it onto the end of tube 64, or by any other suitable attachment method.

Figure 2:
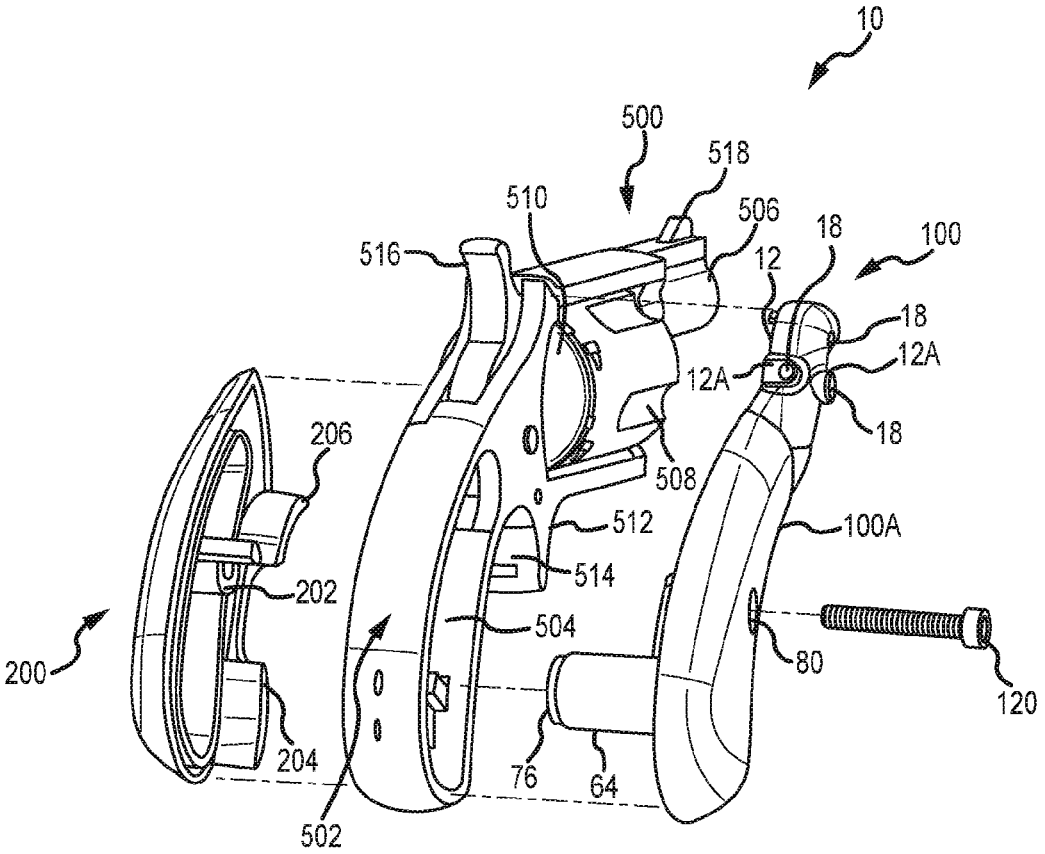
FIG. 2 is a rear, perspective, partially-exploded view of a gun with the lighting device of FIG. 1 not yet assembled on the gun.

FIG. 2 shows an exploded view of a grip according to the invention prior to it being mounted to the handle frame 502 of a revolver 500. In this figure first section 100 is fully assembled. Handle frame 502 has an opening 504 through which portions of first section 100 and second section 200 are pressed together and/or are connected.

Figure 6:
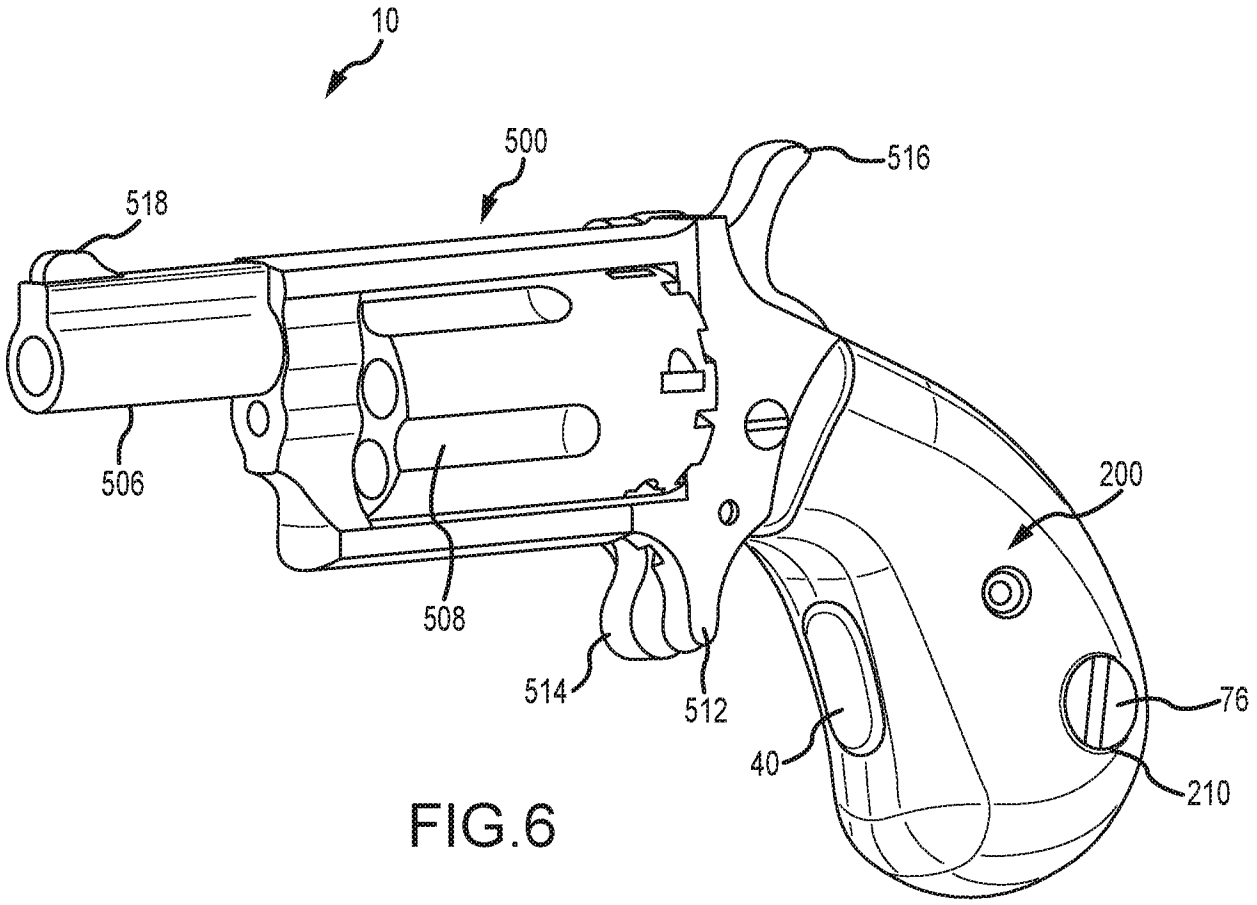
FIG. 6 is a left-side, perspective view of a gun according to FIG. 3.
Figure 7:
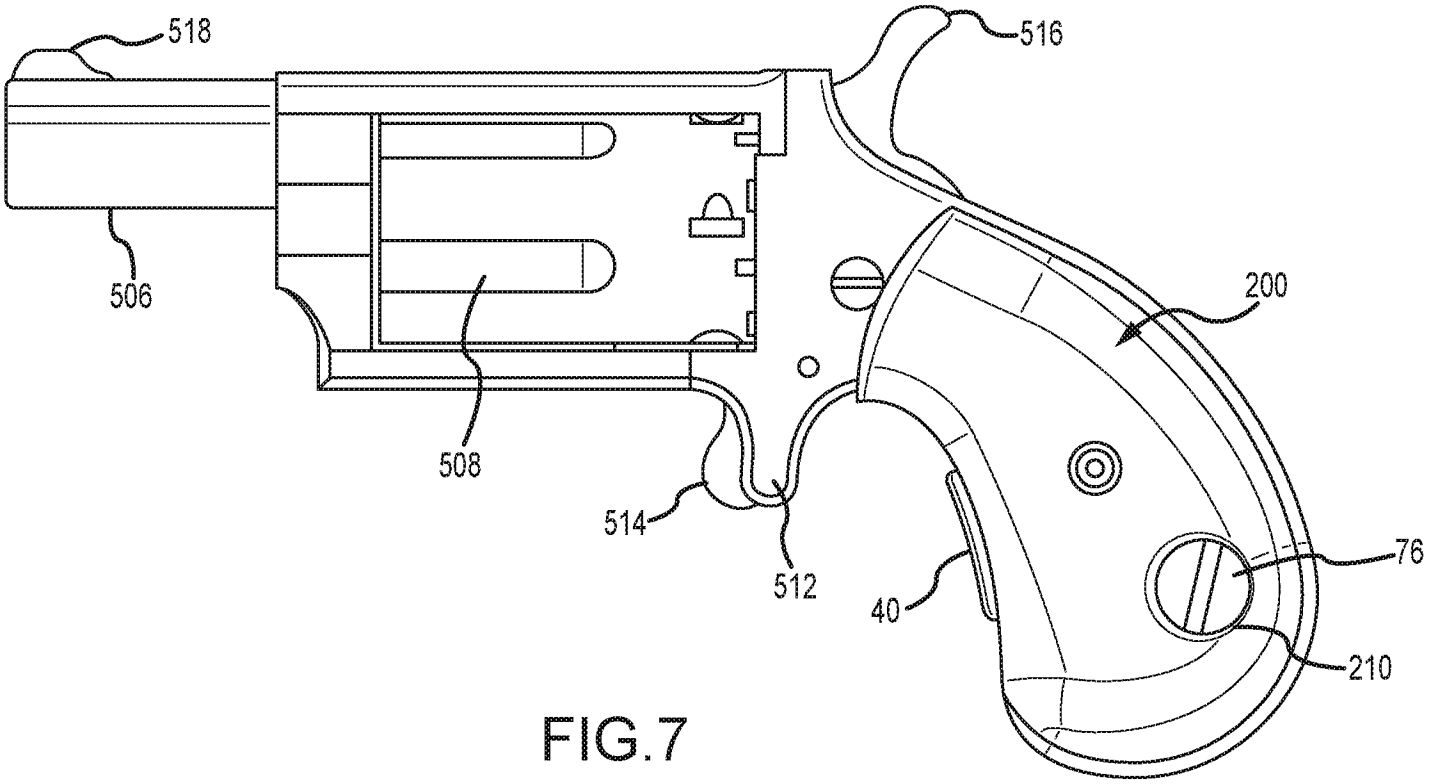
FIG. 7 is a left-side view of a gun according to FIG. 3.
Figure 8:
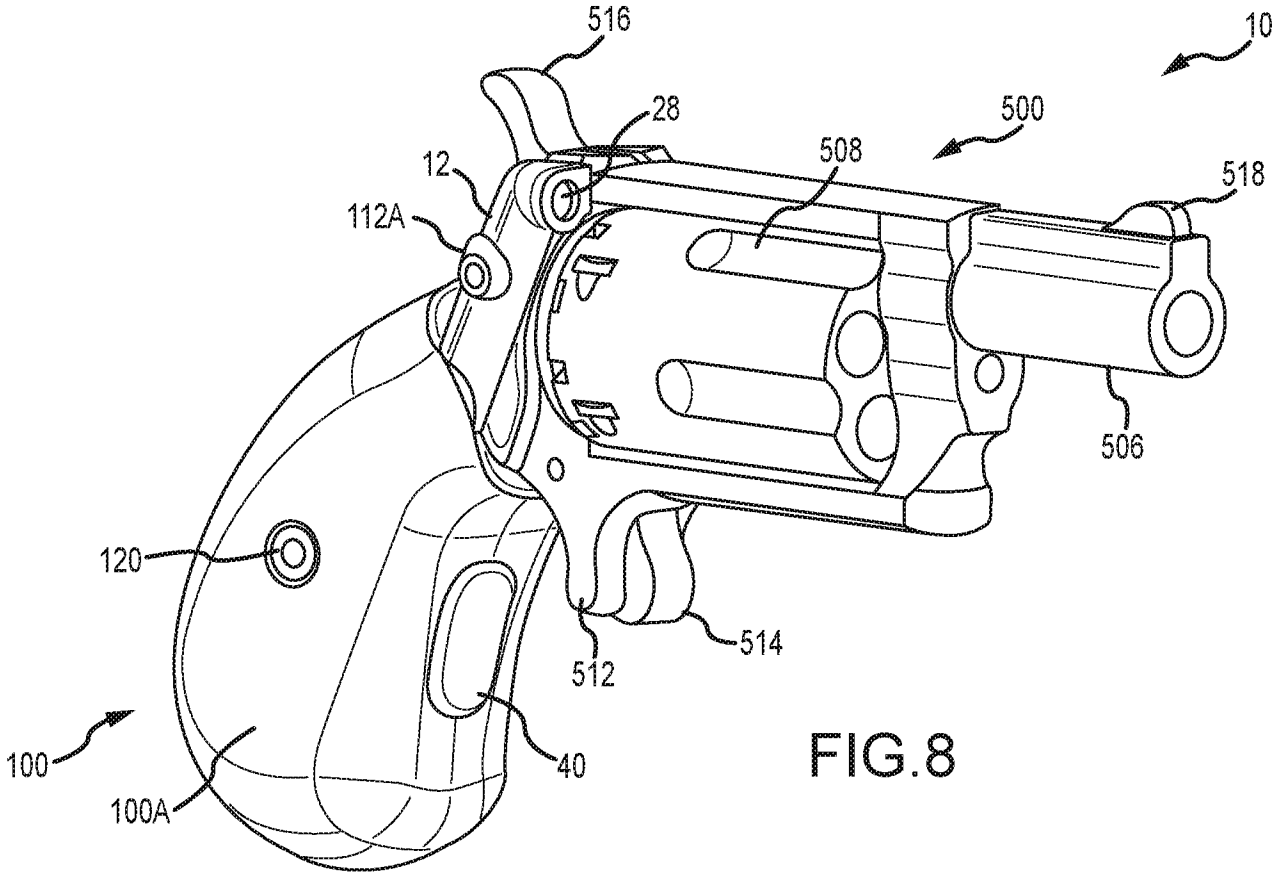
FIG. 8 is a right-side, perspective view of a gun according to FIG. 3.
Figure 9:
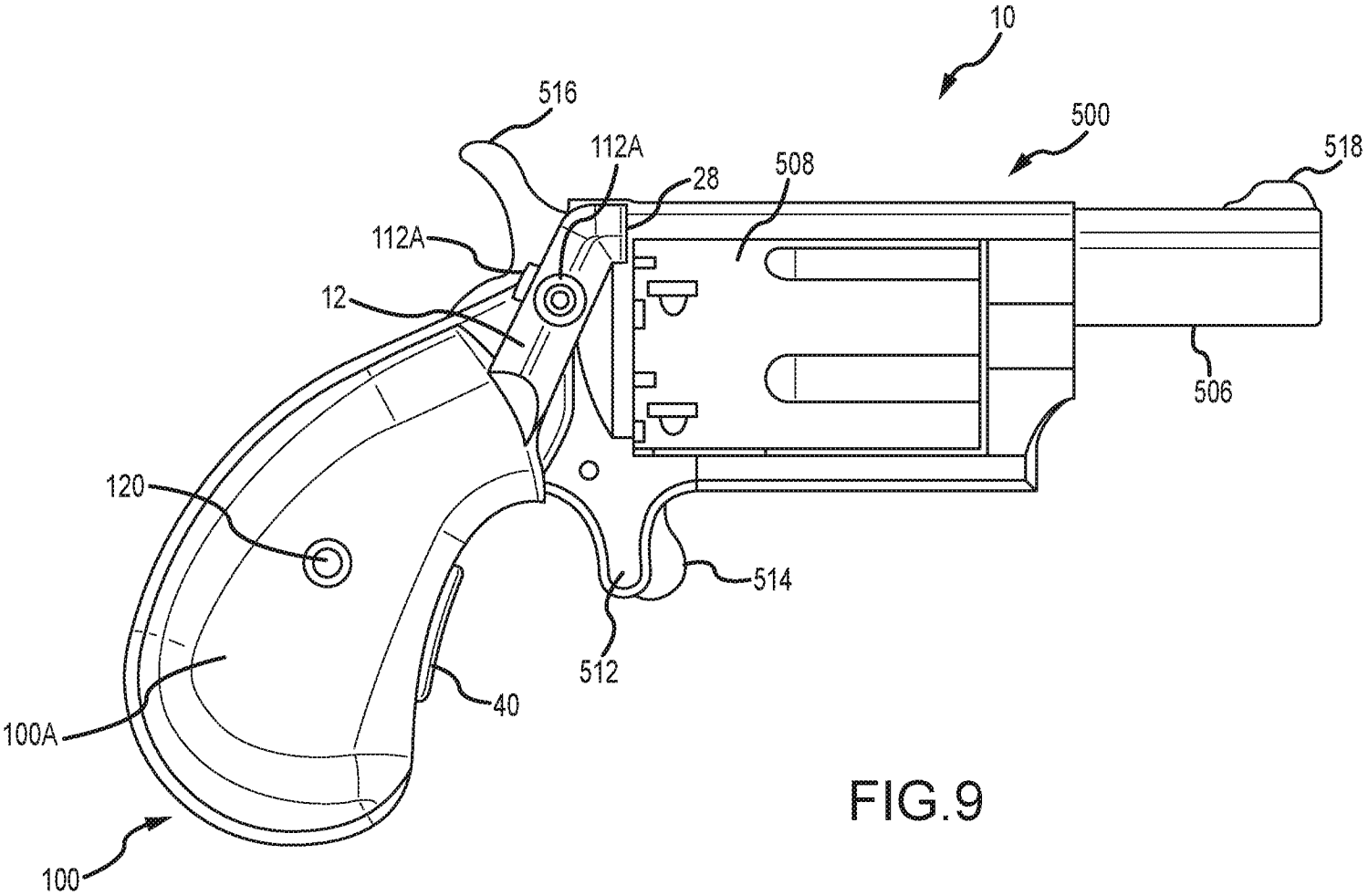
FIG. 9 is a right-side view of a gun according to FIG. 3.

Sections 100 and 200 are pressed against the respective sides of handle frame 502. Screw boss 202 aligns with opening 80, sleeve 204 aligns with slot 42 to retain switch 40, and flange 206 aligns with and presses against flange 41 to create a seal between first section 100 and second section 200. A fastener 120 is passed through opening 80 and threadingly received in screw boss 202 to retain first section 100 and second section 200 in place, although any suitable attachment mechanism may be used. When attached, the cap 76 of battery tube 64 aligns with an opening 210 in second section 200, which can best be seen in FIGS. 6 and 7. In this manner, the battery tube 64 can be easily accessed to remove and replace batteries 62, although any suitable method of battery removal and replacement may be utilized.

In the embodiment shown, the laser module 14 and first section 100 are on the right-hand side of the gun 500. Alternatively, they could be on the left-hand side with first section 100 and second section 200 replaced with respective sections that have the same structures, but reversed.

Figure 3:
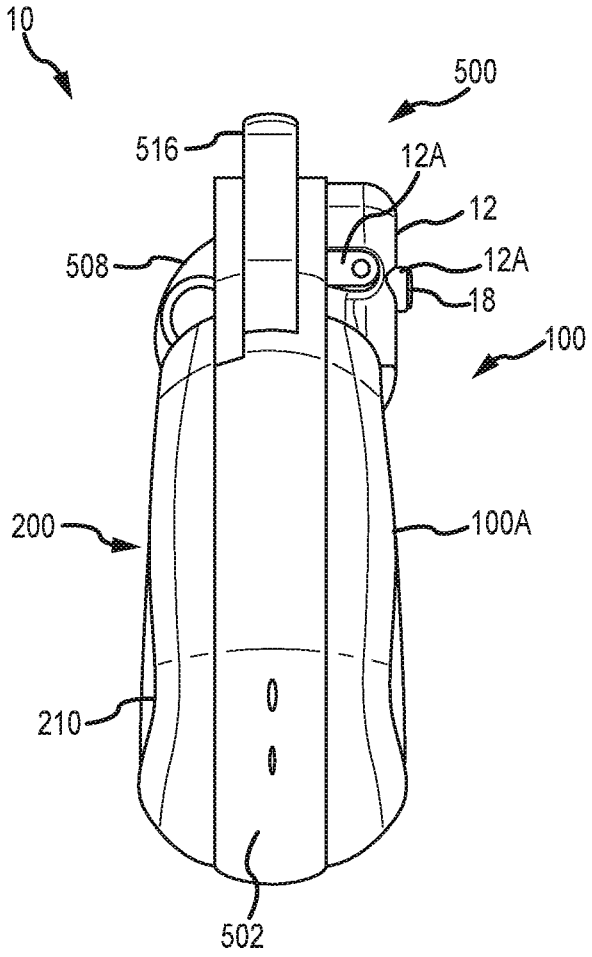
FIG. 3 is a rear view of a gun including a lighting device in accordance with FIGS. 1 and 2.
Figure 4:
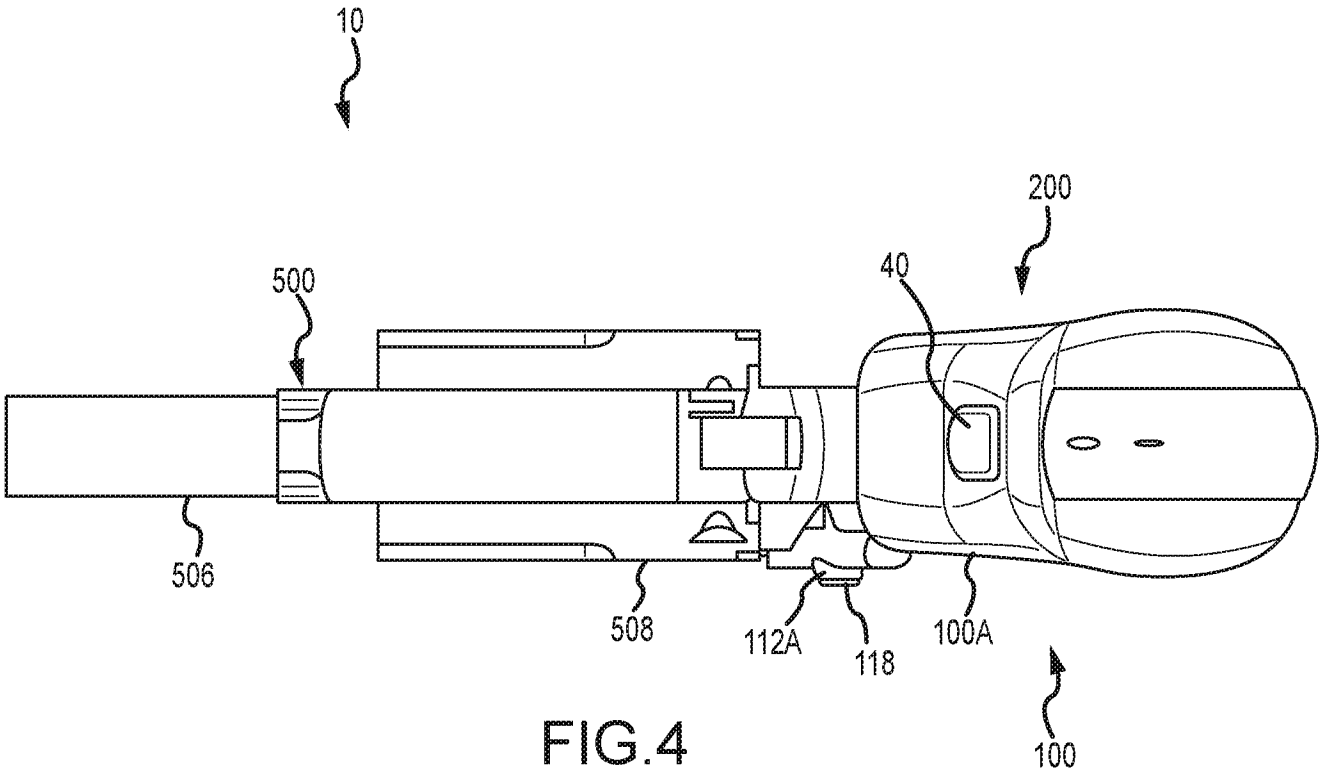
FIG. 4 is a bottom view of the gun according to FIG. 3.
Figure 5:
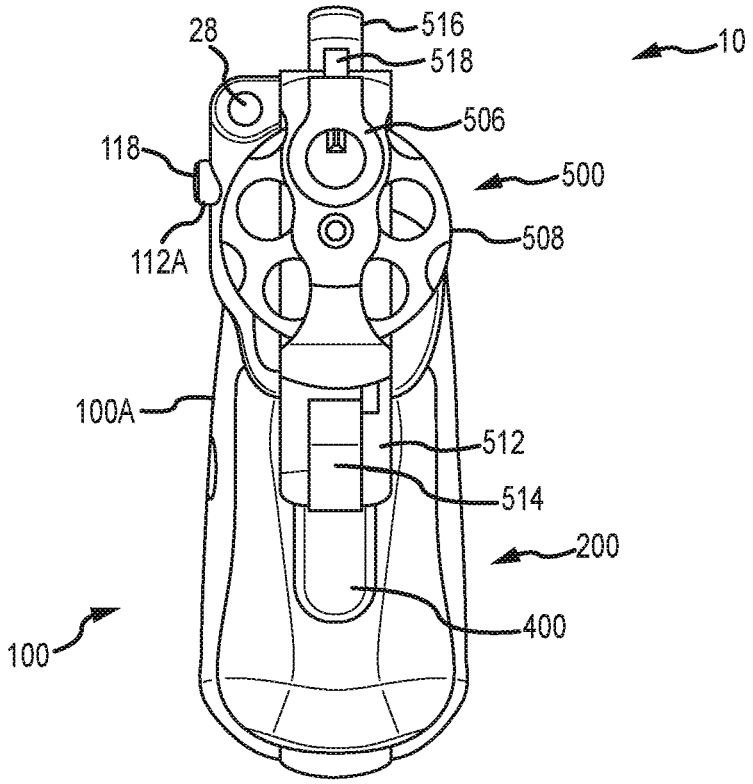
FIG. 5 is a front view of the gun according to FIG. 3.

FIG. 3 is a rear view of device 10. Gun 500 is a revolver with a barrel 506, a cylinder 508 for holding bullets (not shown), an optional back plate 510 (not shown in all figures) that retains the bullets in the cylinder, a trigger guard 512, a trigger 514, a hammer 516 and a mechanical front site 518.

As shown in FIGS. 3-9, the housing 12 and lens 28 are positioned completely behind the trigger guard 512, trigger 14 and cylinder 508 so as to not interfere with the operation of the gun 500. In this embodiment lens 28 is positioned entirely above cylinder 508 so that the light emitted from lens 28 will not be blocked or partially blocked by the cylinder. The housing 12 only extends outward to approximately a position directly even with the outward edge of the cylinder, or by no more than 1/32", 1/16", 1/8" or 1/4" beyond that position. Also, the lens 28 is entirely preferably about 1/32", 1/16", 1/8", or 1/4" above the cylinder.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A lighting device for use with a gun, the lighting device comprising:

(a) a laser module connected to a gun, the laser module also connected to a power source, and the laser module having a first end through which laser light is emitted;

(b) a mirror juxtaposed the first end of the laser module, the mirror redirecting light emitted from the first end; and (c) a switch having a first position wherein power is provided to the laser module so the laser module emits light and a second position wherein power is not provided to the laser module and it does not emit light.

2. The lighting device of claim 1 wherein the laser module and power source are inside of a housing.

3. The lighting device of claim 2 wherein the housing is part of the gun grip.

4. The lighting device of claim 1 wherein the laser module is positions at an angle of 0°-45° from a vertical axis.

5. The lighting device of claim 1 wherein the mirror is not connected to the laser module.

6. The lighting device of claim 1 wherein the position of the laser module can be adjusted thereby adjusting the direction of light emitted from the first end.

7. The lighting device of claim 2 wherein the position of the laser module can be adjusted by set screws threadingly received in openings in the housing.

8. The lighting device of claim 6 wherein the position of the laser module can be adjusted in two directions.

9. The lighting device of claim 1 wherein the mirror is positioned to direct light parallel to a longitudinal axis of a barrel of the gun.

10. The lighting device of claim 1 wherein the power source is one or more batteries.

11. The lighting device of claim 1 wherein the power source is physically separated from the light source.

12. The lighting device of claim 1 that further includes a PCB in electrical communication with the switch and the power source.

13. The lighting device of claim 2 wherein the housing comprises a first section and a second section and the laser module and mirror are in the first section.

14. The lighting device of claim 1 wherein the housing comprises a first section and a second section and a cap is in the second section, wherein the cap is removable to remove and insert batteries.

15. The lighting device of claim 13 wherein the switch is on the first section.

16. The lighting device of claim 13 wherein one or more fastening devices connect the first section to the second section.

17. The lighting device of claim 16 wherein the one or more fastening devices is a single screw.

18. The lighting device of claim 15 wherein the gun has a handle frame and the first section of the housing is positioned on the opposite site of the handle frame.

19. The lighting device of claim 1 wherein the switch is a momentary switch.

20. The lighting device of claim 2 wherein the housing has a lens through which light emitted from the laser module passes.

21. The lighting device of claim 2 wherein the housing is configured to be behind the trigger and trigger guard of the gun.

22. The lighting device of claim 2 wherein the gun is a revolver and the housing is configured to be behind the cylinder of the gun.

23. The lighting device of claim 22 wherein the housing is configured to be above the cylinder of the gun.

24. The lighting device of claim 1 wherein the switch requires a force of 5 lbs. or more to be activated.

25. A gun including the lighting device of claim 1.

26. The gun of claim 25 that is one of the group consisting of: a revolver, a machine pistol, a shotgun, and a rifle.

* * * * *